US005536190A

United States Patent [19]

Althen

[11] Patent Number: 5,536,190

[45] Date of Patent: Jul. 16, 1996

[54] SWIM FIN WITH SELF-ADJUSTING HYDROFOIL BLADES

[76] Inventor: Craig L. Althen, 5533 Golfcourse Dr., Morrison, Colo. 80465

[21] Appl. No.: 519,467

[22] Filed: Aug. 25, 1995

[51] Int. Cl.[6] ..... A63B 31/08

[52] U.S. Cl. ..... 441/64

[58] Field of Search ..... 441/61, 64; D21/239

[56] References Cited

U.S. PATENT DOCUMENTS

| | | | |
|---|---|---|---|
| 4,178,128 | 12/1979 | Gongwer | 416/72 |
| 4,209,866 | 7/1980 | Loeffler | 9/304 |
| 4,689,029 | 8/1987 | Ciccotelli | 441/64 |
| 4,767,368 | 8/1988 | Ciccotelli | 441/64 |
| 4,944,703 | 7/1990 | Mosier | 441/62 |
| 5,330,377 | 7/1994 | Kernek | 441/64 |

FOREIGN PATENT DOCUMENTS

WO94/25116 11/1994 WIPO .

*Primary Examiner*—Edwin L. Swinehart

[57] ABSTRACT

A swim fin comprised of a plurality of hydrofoil blades in which the angle of attack of the blades is automatically self-adjusting by use of negative feedback through one or more hydrodynamic control surfaces. The self-adjustment of the angles of the blades results in continuous optimization of the lift vectors throughout the swimming stroke as well as for different swimming speeds and variations in water currents. To further take advantage of the increased efficiency and power, improved hydrofoil blade designs are recommended. These consist of cambered plate profiles optimized for the range of Reynolds numbers observed in scuba diving. Means to precisely define the cambered profiles, which invert between up and downstrokes, are provided. Provision for additional enhancement of power is disclosed in embodiments which multiply the number of hydrofoil blades by stacking the serial blades in substantially parallel planes without altering the overall length or width of the swim fin.

12 Claims, 7 Drawing Sheets

SWIM FIN WITH SELF-ADJUSTING HYDROFOIL BLADES

BACKGROUND—FIELD OF INVENTION

This invention relates to a swim fin with multiple hydrofoil blades in which the angle of attack of the blades varies automatically throughout a power stroke.

BACKGROUND—PRIOR ART

Most conventional swim fins have but a single blade, but Gongmer (U.S. Pat. No. 4,178,128) shows an early hydrofoil swim fin with two blades. Mosier (U.S. Pat. No. 4,944,703) shows a more advanced form with multiple blades. Both Gongmer and Mosier use full-depth, symmetrical hydrofoil blades which work against a resilient spring tending to center them in a neutral position. Gongmer's design requires springs which must supply a predetermined torque for position control. Mosier's design presents many more valuable features, but uses stops which fix the angle of attack of the blades in predefined positions.

This disclosure presents three improvements to the present technology. The first is the discarding of symmetrical hydrofoil blades as used in the above patents. This disclosure proposes multiple hydrofoil blades capable of changing shape so that an asymmetrical profile is available. Having an inverting profile when changing between upstrokes and downstrokes results in a more efficient hydrofoil shape. Loeffier (U.S. Pat. No. 4,209,866) shows a swim fin with a single hydrofoil-like blade capable of inverting and changing shape. However, Loeffier's swim fin was poorly designed for hydrodynamic efficiency. It possessed no means for accurately forming, controlling, or stabilizing a cambered profile for a proper hydrofoil. Several means to produce properly cambered, inverting hydrofoils are presented in this disclosure. Loeffier similarly fixed the angle of attack by means of a flexible cable or light rope which again functioned as a stop—either elastically or statically. The second key feature is to design the blades so that a self-adjusting angle of attack is obtained. This gives an angle of attack which changes continuously throughout the arc of a power stroke rather than being fixed at one angle as in all previous designs. A third improvement is the stacking of the hydrofoil blades to double or triple the working areas of the blades.

If a diver is swimming at a variable speed, the angle of attack of the fins needs to compensate. The angles also need to adjust to the changing kicking speed observed throughout a power stroke—faster throughout the middle range and slower near the ends of the stroke. Conventional swim fins automatically adjust to all of these situations to some extent since their deflection is in part due to the angle of incident pressure. But this is not true for any of the previous designs based on hydrofoils. The angles are fixed relative to the fin frames, not relative to the angle of incidence of the resultant water currents. In contrast to these situations, if a diver is trying to push a stationary object while wearing hydrofoil fins, the blade positions remain essentially unchanged at their set angles regardless of how fast and hard the diver kicks. This is true for all hydrofoil designs. This is true for the earlier designs because they had fixed angles. This is also true for the disclosed designs because the fins always trace the same stationary arcs (vectors). This is desirable. However under these circumstances, conventional fins fail because as a diver kicks ever harder the fins are progressively deflected beyond their optimum angle. They mush out. This new concept in fin design preserves efficiency in all circumstances and at all times.

An additional embodiment of this new design employs two or more stacks of blades which are aligned as in a turbine. Kernek (U.S. Pat. No. 5,330,377) recognized the general advantage of multiple level fins, but he used only fairly conventional fins with baffles, and he did not recognize the potential of staggered hydrofoil blade positioning. The possibility of multiple ranks of multiple blades as described below has not been appreciated until now.

The general objects and advantages of this invention focus on new hydrodynamic features for swim fins which enable more efficient propulsion. In particular, more efficient, multiple hydrofoil designs are presented, more powerful arrangements of the hydrofoils are proposed, and especially, more effective control means for the hydrofoils are presented which truly optimize the thrust vectors throughout the full range of motion of the power strokes and during all states of relative forward motion. Other objects and advantages will be made evident in the details of the specification.

SUMMARY

During a swimming stroke, the vector due to general forward motion varies. This vector becomes relatively most prominent near the ends of the power strokes, after reaching full speed, and when slowing down. Likewise, this vector is slight or nonexistent when starting from a standing stop or when kicking violently to accelerate. Swim fins ideally need to react in accordance with their resultant motion through the water. With the new designs disclosed below, the angle of attack of the blades is relative to the current and not relative to the main frame of the fins.

Hence this invention relates to swim fins, particularly for use in scuba diving, which use multiple hydrofoil blades. While such designs have not been competitive with conventional fins (flippers) in the past in spite of certain theoretical advantages, this new design adapts the functional compliance seen in flexible swim fins into the usually more rigid designs of hydrofoil fins. Specifically, a variety of designs are presented which provide instantaneous feedback control of the angle of attack of the hydrofoil blades. By combining the new approach, namely the use of hydrodynamic control of the blades along with new means of achieving efficient blade profiles, and the possibility of strategic placement of multiple blades, a new breed of exceedingly powerful swim fins is created. Equivalently, divers can use these fins to swim at normal speeds but with much less muscular effort and energy. These fins also provide an added degree of safety in currents.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings.

FIG. 1A Top or bottom view of double vaned hydrofoil made with material capable of differential bending.

FIG. 2A Top or bottom view of double vaned hydrofoil made with material of uniform bending properties mounted in a shaping frame.

FIG. 5A Top or bottom view of single vane hydrofoil made with material of uniform bending properties mounted in a shaping frame.

FIG. 6A Top or bottom view of rigid control vane hydrofoil.

DESCRIPTION OF THE PREFERRED EMBODIMENTS

Figure 1A:
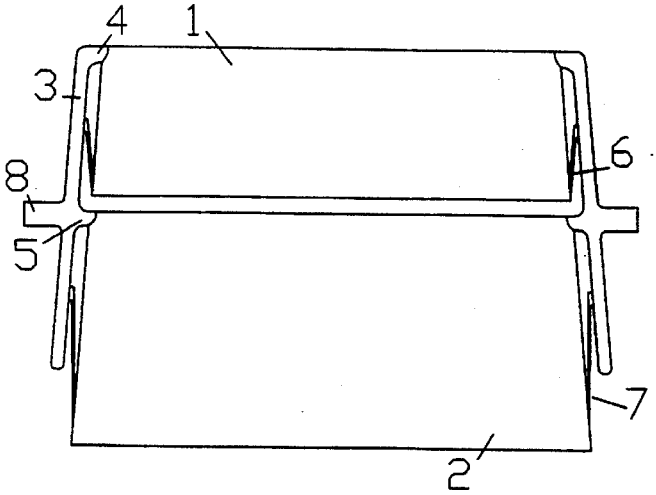
Figure 1B:
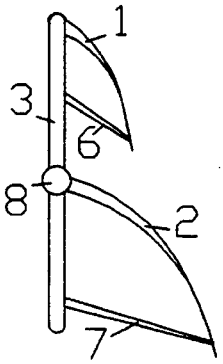
FIG. 1B Side view of hydrofoil of FIG. 1A.

FIG. 1A shows a top (or bottom) view of a hydrofoil blade capable of inverting with a change of direction in order to form a mirror image profile. FIG. 1B shows the same blade in end view while cambered. This blade consists of a forward vane (1) of flexible sheet material and a larger rear vane (2) of similar material, both of which are mounted on a pivoting frame (3). Inside this frame, the stiff but flexible sheets of the front and rear vanes are attached to the leading edge supports (4, 5). The flexible vanes (1, 2) can now easily invert to conform with their motion through the water and produce an appropriate shape to generate high lift. At the fairly low Reynolds numbers seen in diving, a cambered plate can be more efficient than a conventional, full-bodied foil. A number of configurations or designs can help in controlling the toggling action as the sheets or plates bend back and forth between mirror image cambers.

Each vane (1,2) in FIGS. 1A and 1*b* has a rotation limiting means—a front vane control device (6) and a rear vane control device (7). These are shown paired to prevent twisting. The actual construction of these devices can vary. For example, it is possible to use: a solid bar with a sliding base, a telescoping rod, a flexible cable, or a slotted guide. Any of these devices can be fixed with springs or elastic elements to feather the vane to a straight, neutral position if no force is being applied, but this is not absolutely necessary. Relative motion through the water is necessary to billow the vane into its cambered profile.

Figure 3:
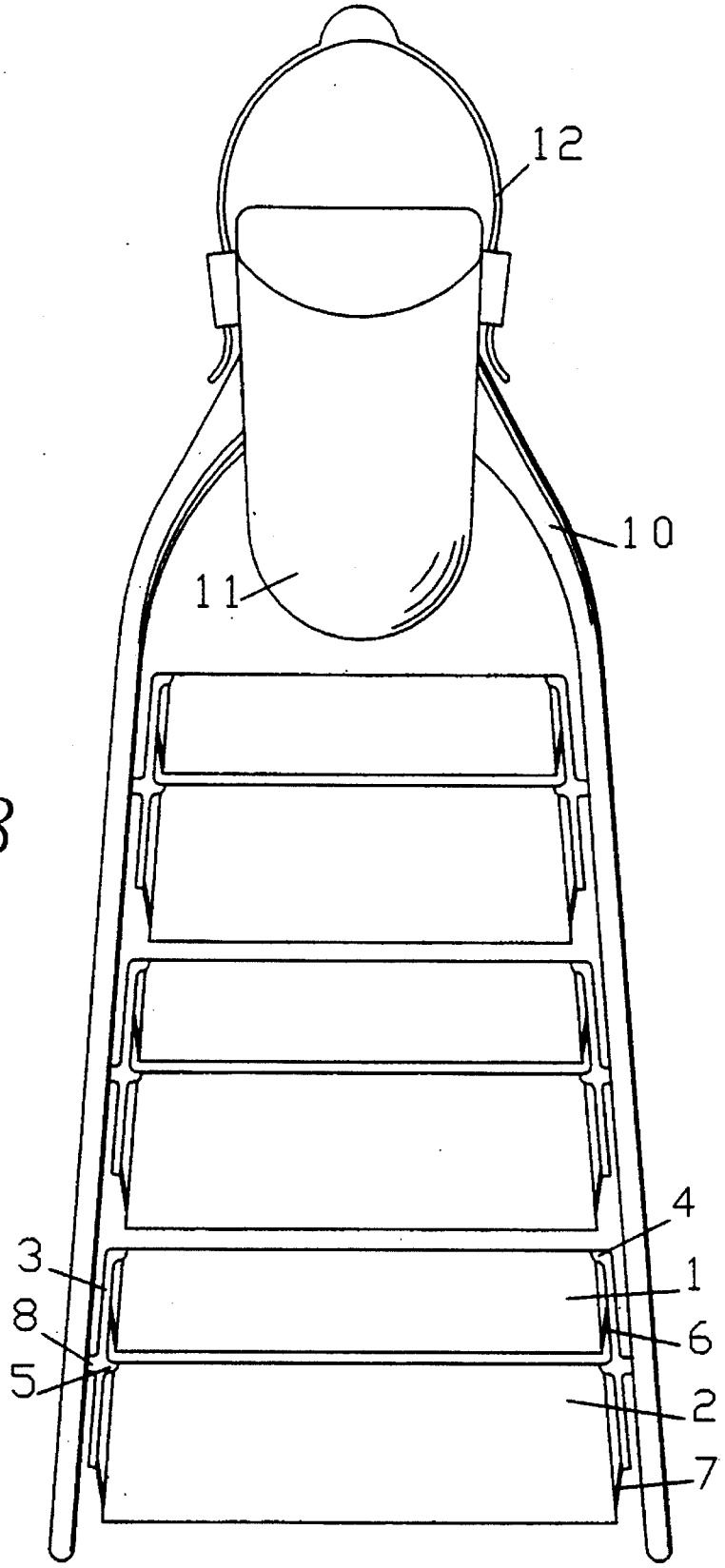
FIG. 3 Top view showing layout for double vaned hydrofoil swim fin.
Figure 4A:
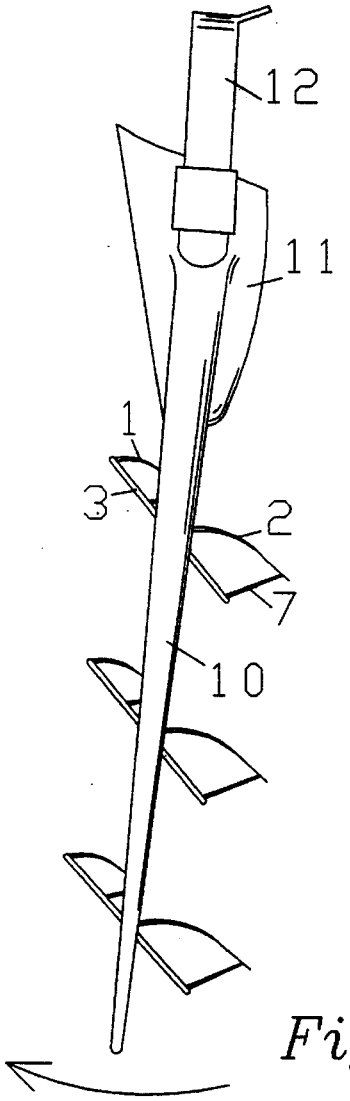
FIG. 4A Side view showing action of vanes of FIG. 3 during mid-upstroke.
Figure 4B:
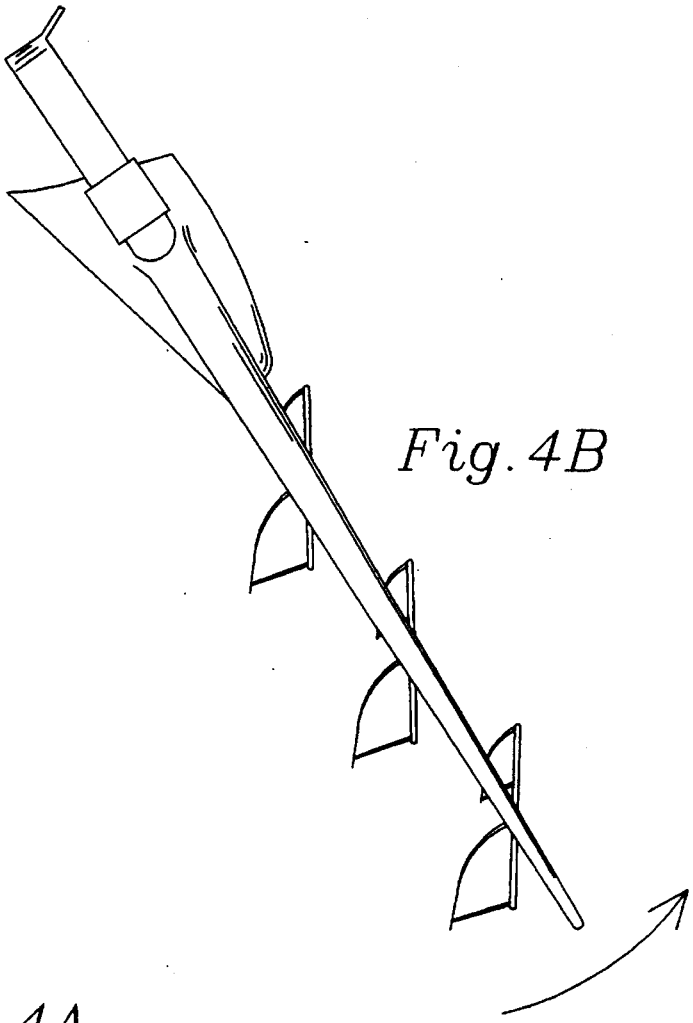
FIG. 4B Side view showing action of vanes of FIG. 3 near end of downstroke.

Many other framework arrangements can achieve comparable results. For example, the trailing edge could have lateral pins engaged in slots. Or, the rear vane (2) could be fixed relative to the frame (3) and only the forward vane (1) could pivot on its trailing edge to achieve a higher angle of attack. The point is to achieve counteracting differential lift capabilities. In this case, differential angles of attack are countered with differential areas. To some extent these vanes have features seen in earlier designs, but now the frames upon which the blades are mounted possess pivots (8) which attach them to the main frame (10) as seen in FIGS. 3, 4A, and 4B. The interaction of the two vanes determines the equilibrium position of the pivoting frame (3) and of the two vanes (1, 2).

In accordance with well established principles, if the pivoting frame (3) is moved transversely through a water column, the larger rear vane (2) will deflect backwards. By itself it would operate like a symmetrical hydrofoil and weathercock to a neutral alignment. However the smaller, forward vane (1) is simultaneously deflected backwards too, so an equilibrium is established when the torques are balanced. Both vanes billow into a cambered profile. The forward vane (1) always sees a higher angle of attack and the rear vane (2) always presents a greater area. As a first approximation, if the vanes are assumed to be working in the region where their lift coefficients are linear, and if the rear vane (2) has 60 percent greater area and the smaller vane (1) can swing to a fixed 10.0 degree higher angle of attack, then known calculations predict the larger vane (2) would swing to 15.8 degrees and the smaller vane (1) to 25.8 degrees. If the frame (3) were somehow displaced to a lower angle of attack than its resulting equilibrium value, the rear vane (2) will lose relatively greater lift and the smaller vane (1) will pull itself and the frame back into position. If the frame is somehow displaced to a higher angle of attack, the opposite situation prevails and the larger vane (2) will quickly recover. The actual, realized equilibrium angles will differ from the calculated values due to interaction of the vanes and other factors. Nonetheless, the empirically determined angles are relatively stable over a wide velocity range. And more importantly, the angles are relative to the forward motion through the water and not relative to the main frame as is usual in hydrofoil swim fins.

In the blade styles of FIGS. 1A and 1B, the vanes are free to bend as they want, so a means to define the desired cambered profiles is necessary. One way is to use vanes with non-uniform flexibility. The flexibility must progressively decrease as one moves aft from the highest camber point towards the trailing edge. The flexibility in the leading edge section must also be controlled. Two of the easiest ways to achieve varying flexibility are—first, to vary the thickness of the material, perhaps using varying numbers of laminations, and second, to use reversible camber-inducing battens similar to those in sailboard sails. Of course, either one, or both in combination, or other more sophisticated construction techniques can be used to assure the correct resulting form.

Another way to precisely define the camber profile is to integrate axial stiffening rods (perpendicular to the direction of normal battens) and then have a series of cables or slots variously fixing the end points of the stiffening rods to conform to the desired shape. However a simplified method derivable from this approach is indicated in FIGS. 2A and 2B.

Figure 2A:
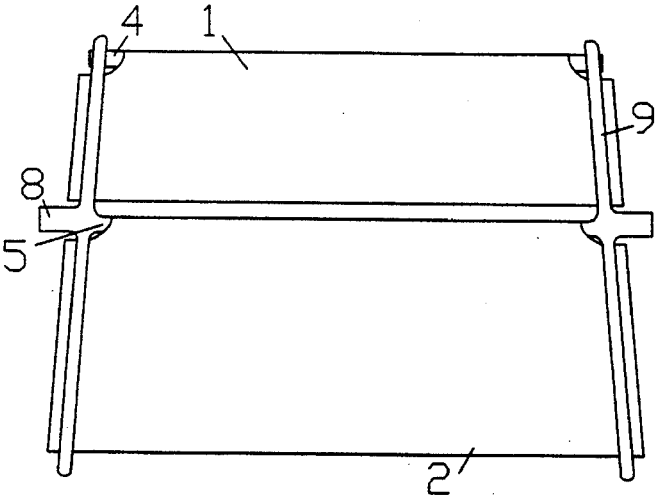
Figure 2B:
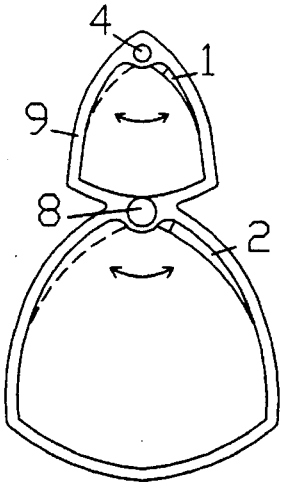
FIG. 2B Side view of hydrofoil of FIG. 2A showing cambered profiles and shaping frame.

In FIGS. 2A and 2B, the contours of the shaping frame (9) provide a means to define the profiles of each vane. The material composing the vanes (1, 2) now can be of any uniform, stiff material capable of bending longitudinally into a high lift profile. Even light-weight material can be used if stiff, longitudinal battens, or other means, are included to prevent buckling. The forward leading edge (4) is an integral part of the frame in FIG. 1A to provide added rigidity. In FIG. 2A the forward leading edge (4) pivots to reduce friction. The rear vane leading edge (5) is integral to the frame (3 and 9) in both examples, and could only be made pivoting if the overall construction is strong enough to maintain alignment of the end pieces and prevent twisting. A third cross member at the trailing edge of the frames is possible for additional strength. Means must be provided to prevent any and all styles of pivoting frames (3, 9, and 13) from pivoting beyond their normal working range so that they never invert upside-down. An internal stop on the pivot (8) reminiscent of Mosier's stops is one elegant solution. Another inherent advantage to all of these styles of hydrofoils is that the vanes are mounted on their leading edges and are composed of resilient material. This means that if there is no pressure, they will instantly and naturally feather. In reality, this state is only observed when a diver is suspended motionless. Any movement instantly snaps the vanes into their working configuration.

FIG. 3 shows a top view of a swim fin using a series of double vaned hydrofoil blades. The spacing must provide mutual clearance between the blades so that there is no interference during reversal. The main frame can be extended beyond that necessary to simply retain the most distal blade. A terminal crossbar can also be added for extra strength. Extensions, with or without a bar, provide some protection for the terminal blade and permit a diver to "stand on one's toes" when stationary on the bottom. This can be both safer and more ecologically sound than standing flat footed as is common with conventional fins.

FIGS. 4A and 4B show the superior functional qualities of this new design principle. The first figure shows an upstroke near the midpoint of the kick. The kick is in the range of its maximum speed and the velocity vector due to the stroke is essentially perpendicular to the direction of motion. The blades are oriented accordingly. In the second figure, the kick is nearing the end of the downstroke. At this position, the kick velocity is dropping rapidly and the kick vector is angled somewhat forward due to the circular arc followed during a kick cycle. This makes the vector due to the general forward motion relatively more important. The blades act in accordance with the resultant motion through the water. The angle of attack of the blades relative to the main frame (10) is altered. These blades will be reversing in a few moments. At the critical moment, the blades will have already completely headed up and will thus be predisposed to changing direction, and will only need to invert through a relatively small angle initially. It is difficult to see, but there is also a subtle variation in the apparent angle of attack (not the actual angle of attack) of the various blades due to the relatively higher lateral velocity component near the tip of the fins.

In selecting the vane angles, it is probably preferable to set the forward vane to as high an angle of attack as is possible without stalling. Then the rear vane is set at a lesser angle depending upon its area (or whatever set of features that result in its counterbalancing torque). In general, front vanes (1) and rear vanes (2) of similar size and similar angles of attack are more efficient. Vanes of dissimilar size and disparate angles of attack establish a more stable equilibrium. An alternative scheme for setting the preferred trim angles is based on establishing the highest L/D (lift/drag) ratio for the combined vanes.

Although the overall size and weight of this fin would be nearly identical to that of conventional fins, this design could be developed into breakdown models for traveling convenience.

Figure 5A:
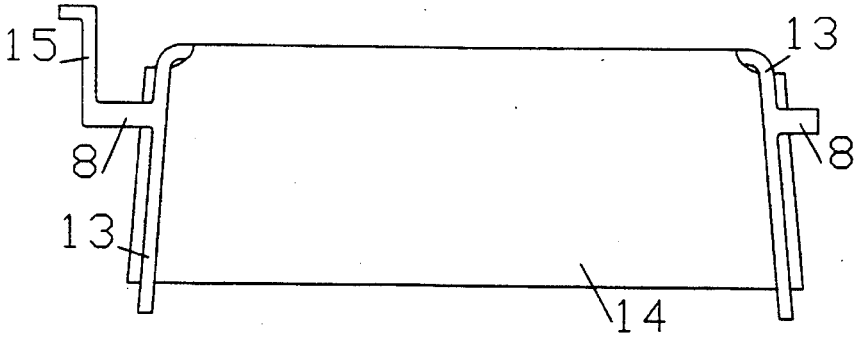
Figure 5B:
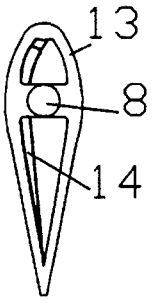
FIG. 5B Side view of hydrofoil of FIG. 5A.
Figure 5C:
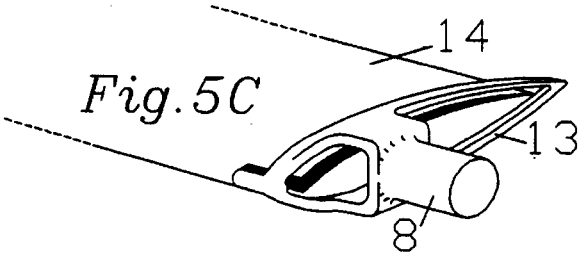
FIG. 5C Perspective view of shaping frame of hydrofoil of FIG. 5A.
Figure 6B:
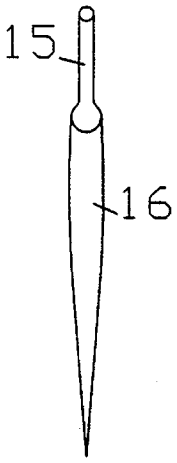
FIG. 6B Side view of hydrofoil of FIG. 6A.
Figure 6A:
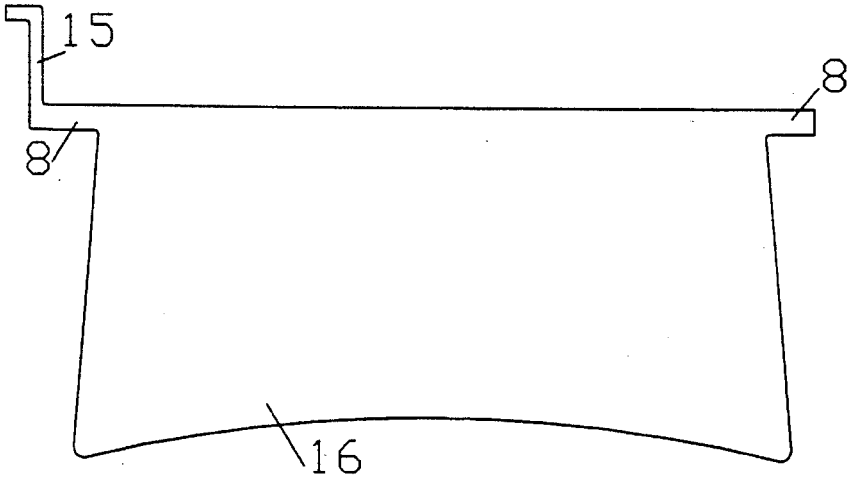

Another means to achieve self-adjusting angle of attack capability in a hydrofoil swim fin is presented in FIGS. 5A, 5B, 5C, 6A and 6B. Instead of having each hydrofoil unit composed of two vanes, a series of single vaned blades (14) is possible. This is accomplished with a control vane (16) interactively linked to simultaneously counterbalance all of the single vanes (14). FIG. 5A shows a single vaned foil (14) using a contour forming frame (13). This vane's camber also inverts to mirror images as the swimmer oscillates between upstrokes and downstrokes. The pivot (8) however is located in the vicinity of the quarter-chord axis. It is slightly posteriorly offset from the neutral area, however, so that the vanes' pivoting moment is definitely unbalanced but only weakly so. FIG. 5B shows this vane in end view without the linkage arm (15). FIG. 5C shows a perspective view. A linkage arm (15) is also present on the control vane (16) illustrated in FIG. 6A in plan view and FIG. 6B in end view.

The control vane (16) simply weathercocks with the current and maintains the alignment of the single vanes (14) by the interconnecting links (FIG.7, 17) joined with the linkage arms (15) of the various blades. Although the control vane (16) as illustrated has potentially little drag, it is important to adjust the interconnecting links (17) so that the control vane (16) is never neutral. Also, this control vane (16) is pictured as rigid, but it could also be an inverting camber type of vane. It must always provide a definite torque on its linkage arm (15) which is transferred to the interconnected single vanes (14). The sum of the single vane moments must be equal and opposite the moment of the control vane (16). In this way a stable, negative feedback system is maintained. A high drag, split-vaned control blade with a "V" cross-section is also possible. In this form, pivoting at the bottom of the "V", the severe dihedral would permit a more neutral orientation of all of the blades, but the system would be susceptible to oscillations.

Figure 7:
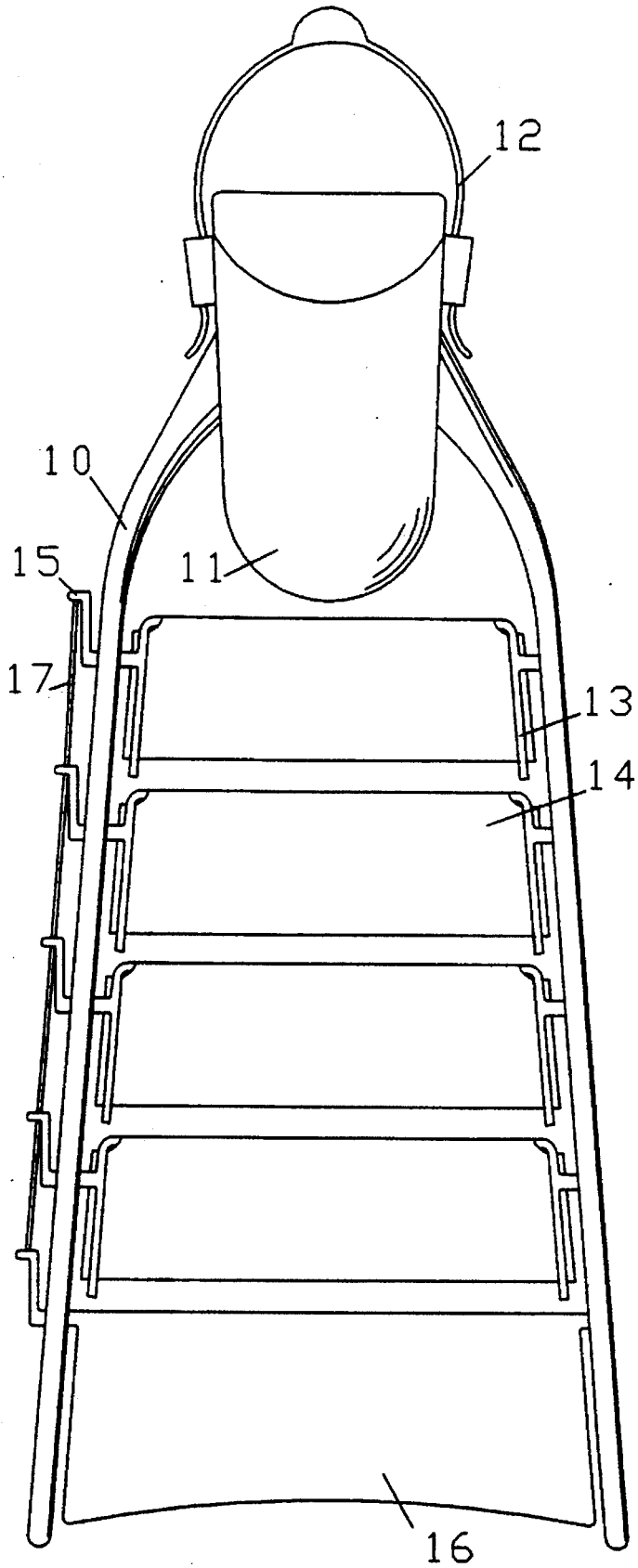
FIG. 7 Top view showing layout for single vaned hydrofoil swim fin.
Figure 8A:
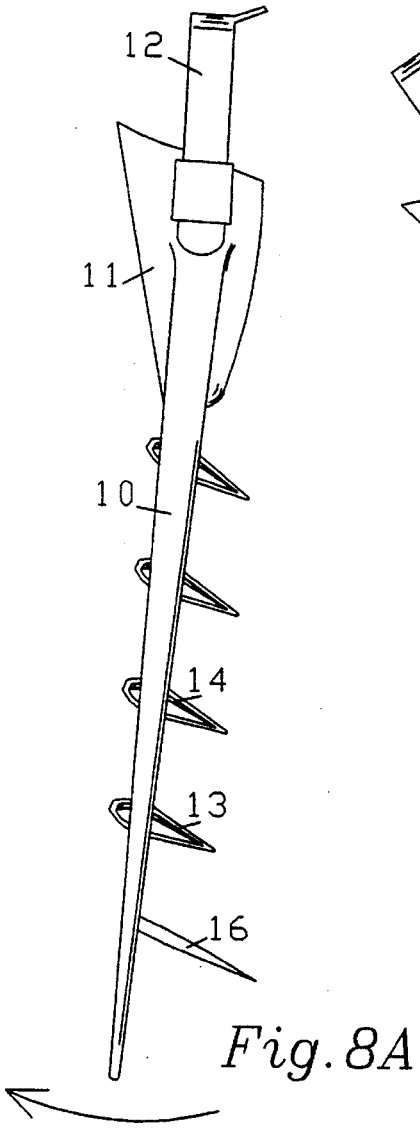
FIG. 8A Side view showing action of vanes of FIG. 7 during mid-upstroke.
Figure 8B:
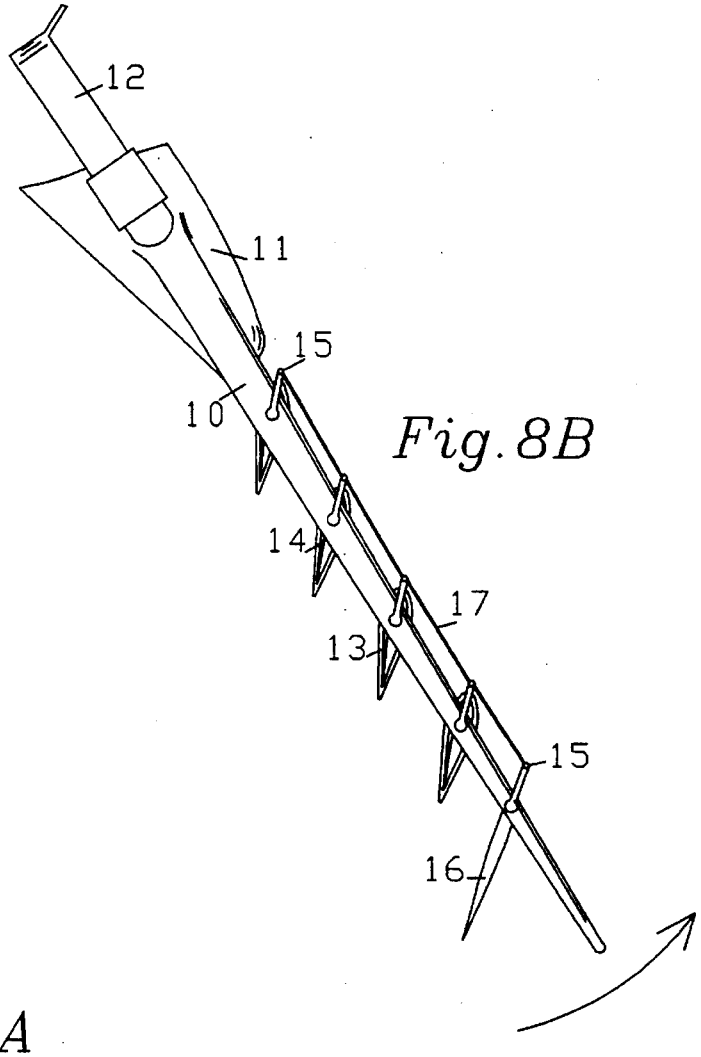
FIG. 8B Side view showing action of vanes of FIG. 7 near end of downstroke.

FIG. 7 shows this embodiment in full layout in top view. FIGS. 8A and 8B show side views comparable to FIGS. 4A and 4B. The exposed control system indicated in FIG. 8B is somewhat exaggerated but easily portrays the underlying principles. In practice the dimensions would be reduced, linkages would exist at both ends of the vanes, and everything would be enclosed in streamlined channels. Otherwise, this is a functional design since different arm lengths (15) and linkage lengths (17) would permit fine tuning. A comparable system could be based on a rack and pinion system. The pivoting control vane (16) would turn the control pinion gears to move the racks up and down. Each vane (14) would communicate through its own pinion gears and could have individual and differential fine tuning by varying the tooth count slightly. With an enclosed system the fins would not have a tendency to snag on anchor lines and so forth. Other control system designs, such as sprockets and belts, are possible.

Figure 9A:
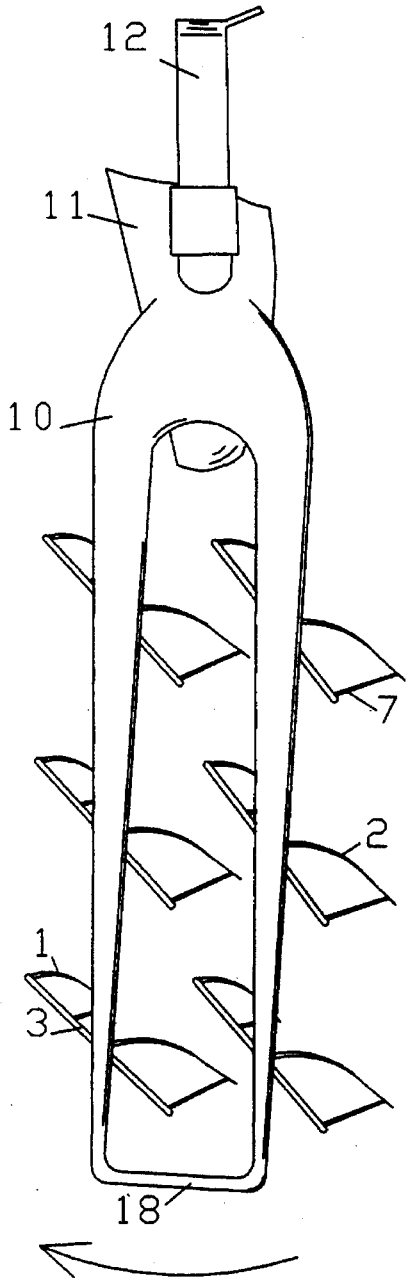
FIG. 9A Side view showing action of stacked double vanes during mi-upstroke.
Figure 9B:
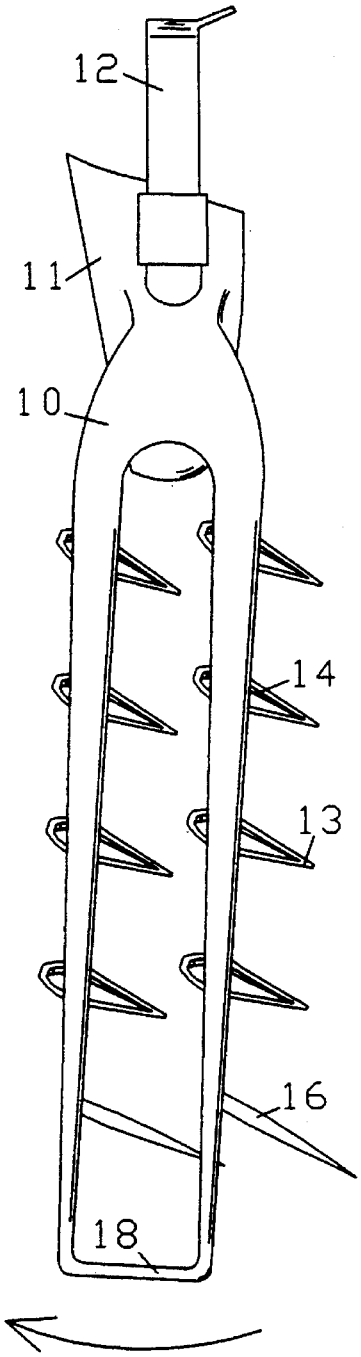
FIG. 9B Side view showing action of stacked single vanes during mid-upstroke.

More power can be generated with greater hydrofoil surface area. Increased width and length very soon become cumbersome, but increased depth is a novel development hereby disclosed for hydrofoil swim fins. Two or more series of blades can be stacked as illustrated in FIGS. 9A and 9B. Because of the reduced drag inherent in these designs, these sophisticated, high powered models are still manageable.

Although multiple series designs are necessarily heavier than single series designs, they could still be neutrally buoyant, or even positively buoyant, under water. The double vaned style could also be engineered as a take-down model. Tremendous speed and efficiency are the hallmarks of these designs. The multiple series designs also have the intrinsic advantage that no special anti-reversing devices are needed for the vanes. If the spacing is correct, the flames, regardless of style, can mutually inhibit reversal of adjacent frames. As shown in FIGS. 9A and 9B, the spacing can be fairly close, though a support beam (18) is recommended, since both sets of vanes naturally pivot from side to side with perfect timing and in unison. Because the vanes are self-adjusting, the rearward rank(s) naturally compensates for the downwash of the forward rank(s).

It is not absolutely necessary to use paired foils in a canard arrangement or to couple serial foils to a control foil to achieve self-balancing angles of attack. For example, another starting point is a Rogallo "delta wing" design. This, too, automatically establishes a stable angle of attack. The principles and mode of action are equivalent to those detailed in the above embodiments.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

I claim:

1. A swim fin having a plurality of hydrofoils mounted on pivoting frames with said pivoting frames being serially mounted in a fixed, main frame through which said swim fin attaches to a swimmer's foot;

the pivoting action and position control of said hydrofoils being controlled by hydrodynamic, negative feedback means.

2. A swim fin as set forth in claim 1 in which said hydrofoils are comprised of vane material capable of bending longitudinally into a high lift profile;

said high lift profile being an intrinsic feature of said vane material by means of differential bending characteristics;

said vane material being capable of bending into opposite, mirror images of said high lift profiles to coordinate with opposing directional forces throughout a swimming stroke cycle.

3. A swim fin as set forth in claim I in which said hydrofoils are comprised of vane material capable of bending longitudinally into a high lift profile;

said high lift profile being controlled by means of a shape forming frame, said frame defining differential bending of said vane material;

said shape forming frame being capable of forming opposite, mirror images of said high lift profiles to coordinate with opposing directional forces throughout a swimming stroke cycle.

4. A swim fin as set forth in claim 1 in which said hydrofoils are comprised of two, coordinating, intercommunicating vanes to provide said hydrodynamic, negative feedback means.

5. A swim fin as set forth in claim 1 in which said hydrofoils are comprised of single vanes coordinating with and intercommunicating with an independent hydrodynamic control device to provide said negative feedback means.

6. A swim fin comprised of a plurality of hydrofoils mounted on pivoting frames with said pivoting frames being serially mounted in a plurality of fixed frames in substantially parallel planes, said plurality of fixed flames co-joined with means to attach to a swimmer's foot;

the pivoting action and position control of said hydrofoils being controlled by hydrodynamic, negative feedback means.

7. A swim fin as set forth in claim 6 in which said hydrofoils are comprised of vane material capable of bending longitudinally into a high lift profile;

said high lift profile being an intrinsic feature of said vane material by means of differential bending characteristics;

said vane material being capable of bending into opposite, mirror images of said high lift profiles to coordinate with opposing directional forces throughout a swimming stroke cycle.

8. A swim fin as set forth in claim 6 in which said hydrofoils are comprised of vane material capable of bending longitudinally into a high lift profile;

said high lift profile being controlled by means of a shape forming frame, said frame defining differential bending of said vane material;

said shape forming frame being capable of forming opposite, mirror images of said high lift profiles to coordinate with opposing directional forces throughout a swimming stroke cycle.

9. A swim fin as set forth in claim 6 in which said hydrofoils are comprised of two, coordinating, intercommunicating vanes to provide said hydrodynamic, negative feedback means.

10. A swim fin as set forth in claim 6 in which said hydrofoils are comprised of single vanes coordinating with and intercommunicating with an independent hydrodynamic control device to provide said negative feedback means.

11. A swim fin comprised of a plurality of serially arranged, transverse hydrofoils;

said hydrofoils being pivotally mounted and having means for self-adjustment of angle of attack by means of a counterbalancing torque produced by means of hydrodynamic forces on a compensating control surface.

12. A swim fin as set forth in claim 11 wherein a plurality of said serially mounted hydrofoils are vertically deployed in substantially parallel planes to increase the number of said hydrofoils without a substantial increase in length or width ofsaidswimfin.

* * * * *